US009512556B1

(12) United States Patent
Kazravan

(10) Patent No.: US 9,512,556 B1
(45) Date of Patent: Dec. 6, 2016

(54) DEVICE FOR DRYING THE INSIDE OF A PAIR OF WORK GLOVES

(71) Applicant: Saba Jazmin Kazravan, Miami Beach, FL (US)

(72) Inventor: Saba Jazmin Kazravan, Miami Beach, FL (US)

( * ) Notice: Subject to any disclaimer, the term of this patent is extended or adjusted under 35 U.S.C. 154(b) by 0 days.

(21) Appl. No.: 14/960,683

(22) Filed: Dec. 7, 2015

(51) Int. Cl.

| | |
|---|---|
| ***A47F 7/00*** | (2006.01) |
| ***D06F 59/04*** | (2006.01) |
| *A47G 25/02* | (2006.01) |
| *A47F 5/01* | (2006.01) |

(52) U.S. Cl.
CPC ..... *D06F 59/04* (2013.01); *A47F 5/01* (2013.01); *A47G 25/02* (2013.01)

(58) Field of Classification Search
CPC ..... D06F 9/04; A47G 25/02; A47F 5/01
USPC ..... 211/85.3, 181.1; 34/104, 437; D34/58, D34/59, 55, 3; 223/78–80, 84
See application file for complete search history.

(56) References Cited

U.S. PATENT DOCUMENTS 390,571 A * 10/1888 Currie ..... A47G 25/76 211/32
D35,246 S * 10/1901 Stowell ..... 206/9
686,884 A * 11/1901 Becker ..... D06F 59/04 223/79
818,178 A * 4/1906 Lane ..... D06F 59/04 211/85.3
1,221,165 A * 4/1917 Gillam ..... D06F 59/04 223/80
1,319,579 A * 10/1919 Gillam ..... D06F 59/04 223/78
1,467,187 A * 9/1923 Metzger ..... H01J 17/491 223/78
1,517,432 A * 12/1924 Kayte ..... A47J 29/06 211/181.1
1,543,829 A * 6/1925 Doyle ..... D06F 59/04 219/523
1,557,251 A * 10/1925 Hamlin ..... A47G 25/0685 135/87
1,736,679 A * 11/1929 Tierney ..... D06F 59/04 223/78
1,755,902 A * 4/1930 Tascarella ..... D06F 59/04 211/182
2,565,455 A * 8/1951 Miller ..... A61B 42/00 118/308
2,604,998 A * 7/1952 Arbib ..... A47G 25/74 16/87.4 R
2,633,995 A * 4/1953 Edelheit ..... A47G 25/746 211/124
2,682,956 A * 7/1954 Pike ..... A47F 5/0876 211/181.1
D176,436 S * 12/1955 Youhouse ..... D32/58
D195,137 S * 4/1963 Jennings ..... D32/59
3,096,008 A * 7/1963 Schumacher ..... A47F 8/02 211/85.3
3,133,682 A * 5/1964 Sawyer ..... D06F 59/04 211/85.3
3,200,959 A * 8/1965 Theim ..... A47F 5/01 211/181.1
3,363,777 A * 1/1968 Cooper ..... A47G 25/0685 211/100

(Continued)

*Primary Examiner* — Joshua J Michener
*Assistant Examiner* — Devin Barnett
(74) *Attorney, Agent, or Firm* — Malin Haley DiMaggio & Bowen, P.A.

(57) ABSTRACT

A support stand for drying the inside surfaces of a pair of work gloves. First and second thin flat frames having five vertical projections representing a thumb and fingers are vertically supported by a circular base. Each vertical projection has a finger tip glove contact cap to support the glove vertically and spread open each finger passage. The circular base can be separated into halves for storage.

4 Claims, 5 Drawing Sheets

(56) References Cited

U.S. PATENT DOCUMENTS 3,405,382 A * 10/1968 Wright ..... H01C 1/14 174/267
3,409,142 A * 11/1968 Mechaneck ..... F26B 9/00 211/85.3
3,477,622 A * 11/1969 Appelt ..... D06F 59/04 223/78
3,486,670 A * 12/1969 Sutton ..... D06F 59/04 223/78
3,760,530 A * 9/1973 Dahlgren ..... A01M 23/30 43/88
D243,313 S * 2/1977 Varnado ..... D32/58
4,209,913 A * 7/1980 Wallin ..... D06F 59/04 223/51
4,638,915 A * 1/1987 Kaplan ..... D06F 59/04 211/85.3
D322,344 S * 12/1991 Winkler ..... D32/58
D361,914 S * 9/1995 Nagy ..... D32/58
5,692,316 A * 12/1997 Antal ..... A47L 23/205 34/106
D391,720 S * 3/1998 Schoenewolf ..... D32/59
6,085,436 A * 7/2000 Peet ..... D06F 59/04 223/78
D585,169 S * 1/2009 Barzegar ..... D32/58
8,006,433 B1 * 8/2011 Bryanton ..... A01G 9/12 47/45
9,033,195 B1 * 5/2015 Martinez-Ramos .... D06F 59/04 211/85.3
2003/0009902 A1 * 1/2003 Kirk ..... A47L 23/20 34/104
2004/0181963 A1 * 9/2004 Morris ..... D06F 59/04 34/103
2008/0083131 A1 * 4/2008 Wess ..... D06F 59/04 34/239
2010/0314343 A1 * 12/2010 O'Leary ..... D06F 59/04 211/85.3
2011/0265611 A1 * 11/2011 Raman ..... B25B 13/481 81/57.22
2013/0212900 A1 * 8/2013 Stewart ..... D06F 59/04 34/275
2013/0233816 A1 * 9/2013 Greenfield ..... A47B 49/00 211/85.3
2016/0100638 A1 * 4/2016 Megat Abdul Aziz . B29C 41/14 2/163

* cited by examiner

DEVICE FOR DRYING THE INSIDE OF A PAIR OF WORK GLOVES

BACKGROUND OF THE INVENTION

1. Field of the Invention

This invention relates generally to a support stand for drying a pair of gloves, and specifically to a fold-up support stand for drying the inside surface of a pair of work gloves.

2. Description of the Prior Art

Many people in different professions, occupations and domestic situations use work gloves almost every day. Examples would be construction workers, gardeners, and people taking care of residential and commercial buildings.

One significant problem of wearing a pair of work gloves is sweating that results in internal moisture because of the materials used in the work glove construction. Sweat accumulates on the inside surface of the work gloves. Because the sweat is inside the glove, which includes elongated enclosed passages necessary for fingers and the thumb, it is difficult for air circulation to remove perspiration and sweat and any other moisture from the inside each glove. This can be very detrimental to the skin of a person as bacteria and germs can grow in a moist wet environment inside the glove.

The device described herein provides a support for a glove individually together that allow gravity and air flow to remove excess moisture and increase airflow around the inside surface of each glove in a pair of gloves to aid in evaporation and removal of moisture. The device described herein also is easily stored when not in use because the device can be folded up in a compact unit for storage.

SUMMARY OF THE INVENTION

A device for vertically supporting a pair of work gloves, individually left hand and right hand, for drying the inside surface of each glove comprising first and second thin, flat hand-shaped frames, each frame vertically attached perpendicularly at its lower end to a circular base. The first and second frames may or may not be parallel and disposed on opposite sides of the circular frame across the diameter from each other.

The first and second frames in some embodiments may be constructed of a metal or plastic rod shaped and formed like a hand, with the fingers and thumb parallel, oriented upwardly and vertically.

The circular base is rod-shaped and made of two manually separable rigid semi-circular arcs joined together by fasteners at both ends. The base also has at least three spaced apart feet connected to the base arcs for stable support.

The separable semi-circular arc base elements can be manually positioned adjacent each other and joined to fasteners for storage wherein the first and second frames are essentially flush with each other.

The first frame can vertically support a first glove and the second frame can vertically support a second glove for drying. Each glove is manually positioned on the first frame and the second frame by pulling an open glove end above and over the top of the each frame. Each glove is then pulled down over the frame, aligning the respective glove fingers with the corresponding first and second frame member projections representing individual fingers and the thumb.

The first planar vertical glove support rod represents one hand of a human being that is pointed upwardly so that a glove can be positioned over the four digit parallel projections representing the fingers of the glove and the fifth projection can be used to receive the thumb of a glove. The glove opening is at the bottom so that any interior glove moisture, sweat or liquid inside the glove on the inside surface can escape by gravity in a downward direction through the bottom glove opening and by evaporation.

In some embodiments the first and second frame vertical projections representing the four fingers and thumb on each frame will be capped with hemispherically-shaped end caps that act to spread out the finger and thumb passages of the glove when the glove is attached to the frame and to support the glove interiorly at the finger and thumb tips. The end caps are removably attached to the uppermost ends of the finger and thumb projections using slots formed in one side of the end caps. The end caps also function to open up the glove finger and thumb passages to get more air for evaporation.

The first planar vertical glove support rod and the second planar vertical glove support rod are very narrow in diameter which allows for maximum airflow when a glove is supported on top of the first rod in the second round. Each digit of each first and second rod occupies a minimum volume when a glove is placed over each of the rod digits, which allows for more action between the air and gravity on the inside surface of a glove to remove any sweat or moisture contained therein.

In operation the worker that uses work gloves especially daily can use the present invention and allow the work glove pair to be dried out overnight, ready for use the next day, eliminating moisture and bacteria growth inside each glove.

The glove frames could be make for different size gloves such as small, medium or large. The gloves frame could be custom shaped larger or smaller for a specific type of work glove.

It is an object of this invention to provide a work glove drying support stand that allows the inside of each work glove being supported to dry by the action of gravity and evaporation permitted within it.

DETAILED DESCRIPTION OF THE INVENTION

Figure 1:
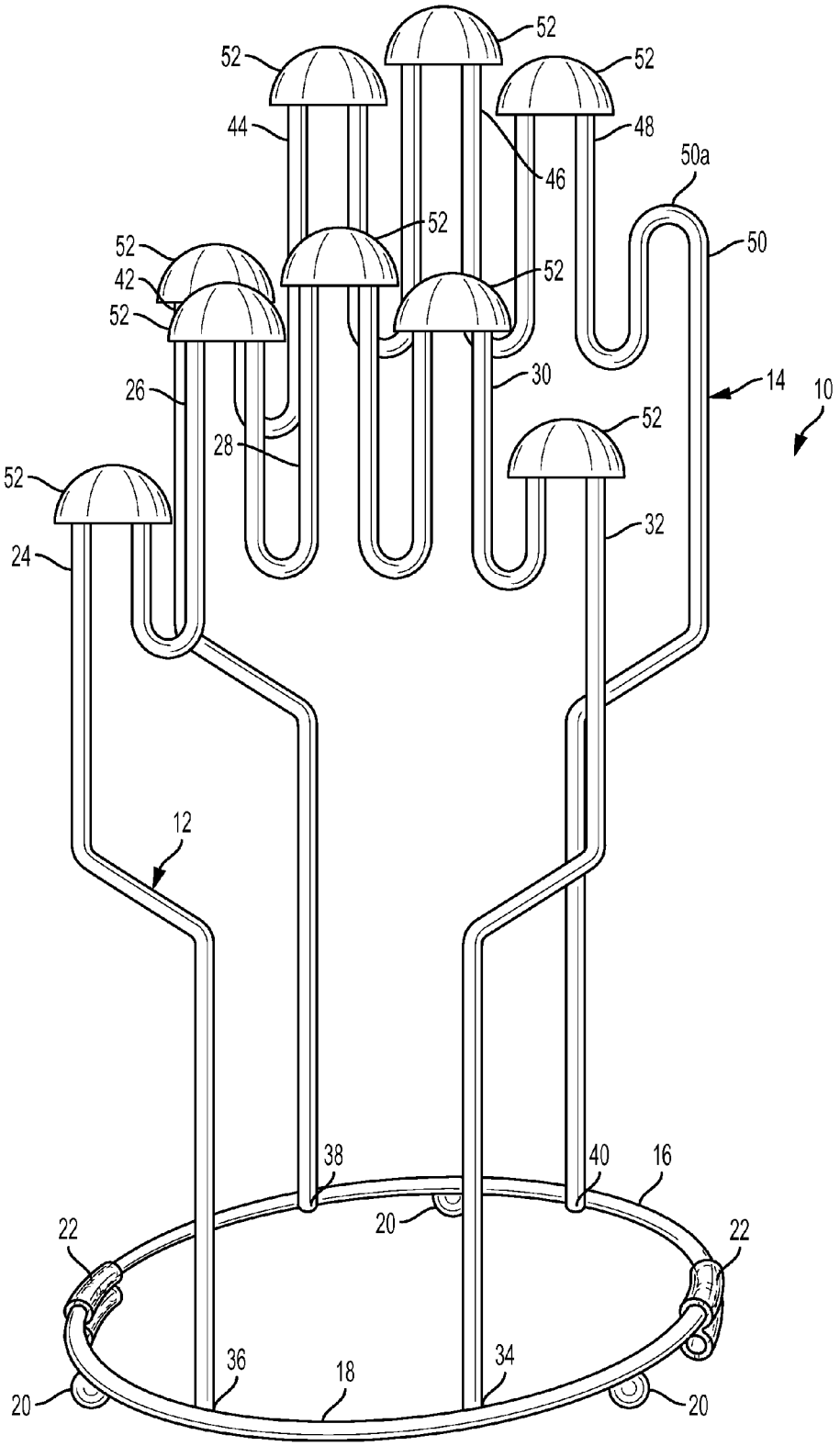
FIG. 1 shows a perspective view of the invention.

Referring now to the drawings, and in particular, FIG. 1, the glove drying device 10 is shown comprising a first thin planar frame 12 vertically attached at its ends 34 and 36 to a semicircular rigid base 18 that has two spherical feet 20 and a second thin planar frame 14 vertically attached at its ends 38 and 42 a semicircular rigid base member 16 which has a spherical foot 20. Semicircular base member 16 is attached to semicircular base member 18 forming a circular base using fasteners 22 which include hollow passages that receive the end portions of the semicircular base members 16 and 18. The circular base made up of semicircular base member 16 and semicircular base member 18 provides a stable circular base that supports the first frame 12 vertically and the second frame 14 vertically.

First frame 12 is essentially identical in size and shape to the second frame 14. In some embodiments the first frame 12 and the second frame 14 are formed from a metal rod that can be bent and that is quite rigid for glove support vertically. First frame 12 has five vertical projections that are essentially straight that represent first vertical projection 24 that represents the thumb, a second vertical projection 26 representing a second or index finger, third vertical projection 28 representing a third finger, fourth vertical projection 30 representing the fourth finger and a fifth vertical projection 32 that represents the baby finger. The first frame vertical projections 24, 26, 28, 30, and 32 are sized in width and length to receive the corresponding thumb and fingers of a glove which will be supported vertically with a glove open and facing downwardly towards the base members 16 and 18.

The second frame member 14 includes a first vertical projection 42 representing a thumb, a second vertical projection 44 representing the second finger, third vertical projection 46 representing the third finger, fourth vertical projection 48 representing the fourth finger and a fifth vertical projection 50 representing the baby finger. Each of the vertical projections 42, 44, 46, 48, and 50 on the second frame 14 receive the thumb and corresponding finger passages of a glove which is supported vertically on second frame 14 with the glove open end facing downwardly towards the base element 16 and 18.

The first frame vertical support members 24, 26, 28, 30, and 32, each have a fingertip glove contact cap 52 attached thereto at the very top of each vertical projection. The fingertip glove contact cap 52 hemispherically shaped so that the cap 52 spreads open the glove finger passages as the glove is attached to the first and second frames and provides tip support for the glove in each finger and thumb passage of the glove for supporting the glove vertically on the frame 12 and on frame 14.

Figure 2:
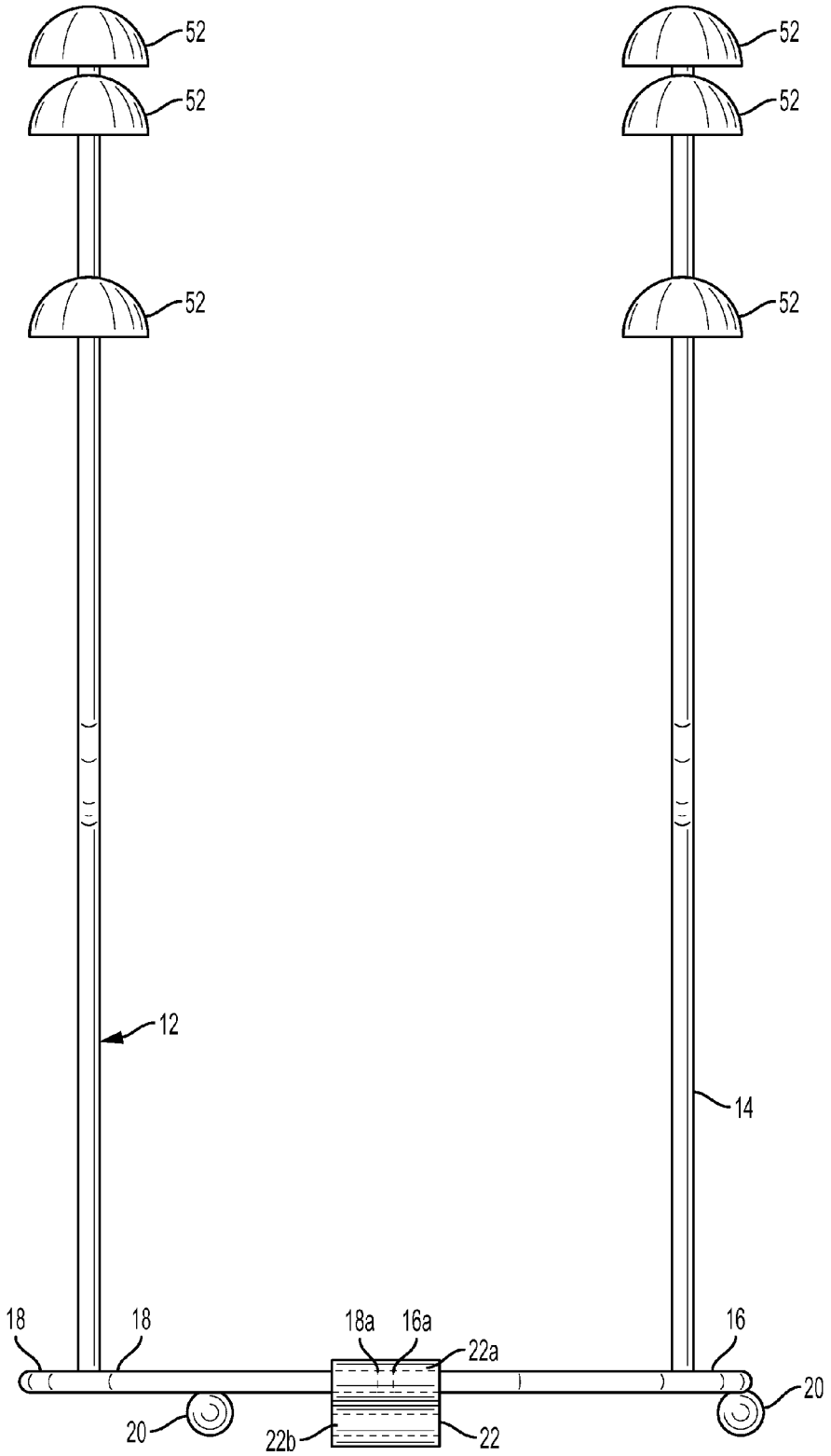
FIG. 2 shows a side elevational view of the invention.

Referring now to FIG. 2, first frame 12 and second frame 14 are shown parallel to each other. The semicircular rigid base member 16 and 18 are shown connected together with a fastener 22 that includes a hollow passage 22*a* that receives the ends 16*a* and 18*a* of the semicircular base member 16 and 18, holding them together within fastener 22. The diameters of the semicircular base members 16 and 18 are sized to fit snugly within the fastener passage 22*a*. The base members 16 and 18 can be separated manually by pulling them apart from the fastener 22, thereby dividing the entire device into halves for storage which is explained below. Fastener 22 has a second lower passage 22*b* that can be used to engage the semicircular base member 16 and semicircular base member 18 on the same side of fastener 22 essentially adjacent each other for storage.

Figure 3:
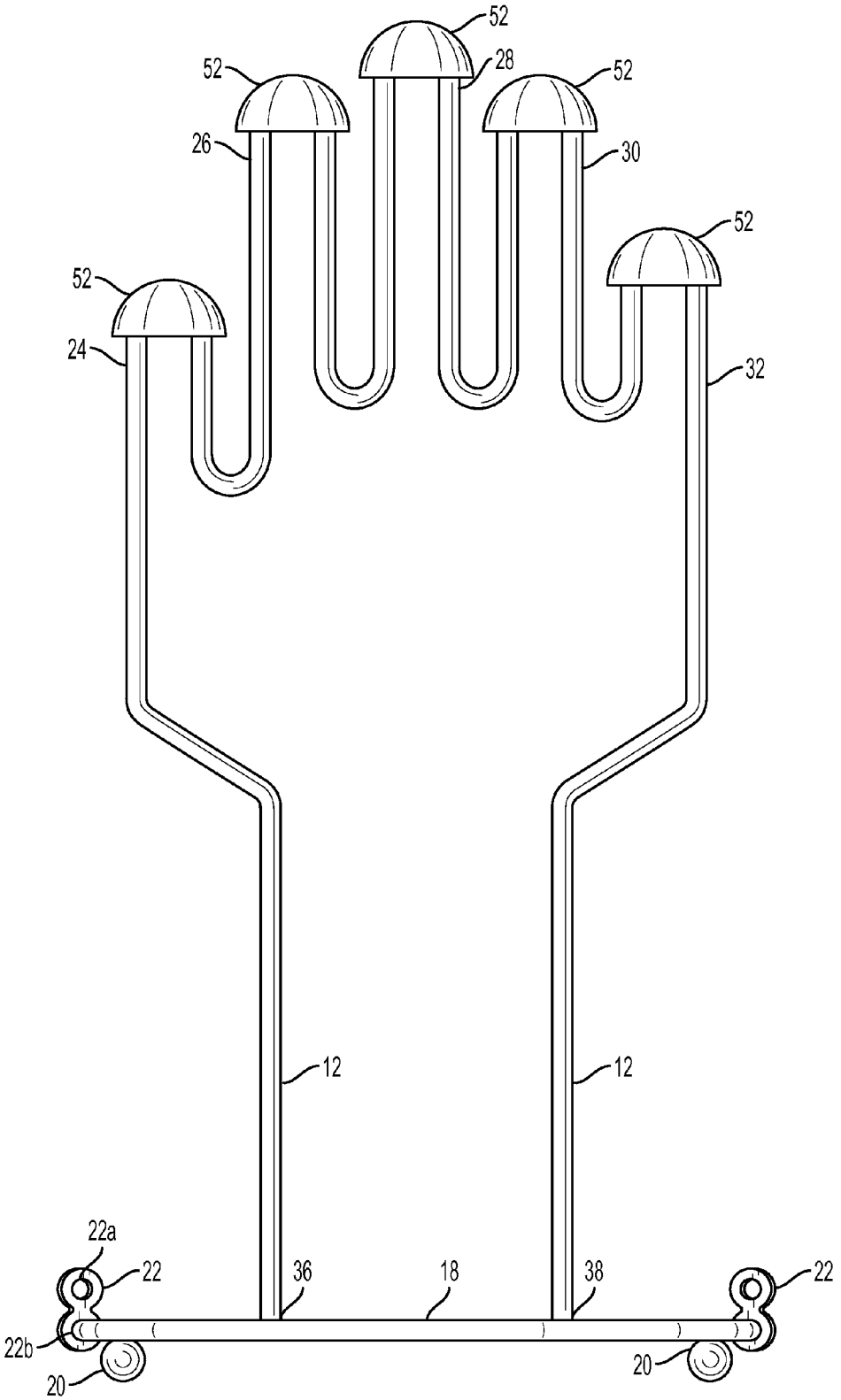
FIG. 3 shows a front elevation of the invention.

FIG. 3 shows a front elevational view of first frame 12 that includes the first vertical projection 24 representing the thumb, second vertical projection 26 representing the second or index finger, third vertical projection 28 representing a third finger, fourth vertical projection 30 representing a fourth finger, and fifth vertical projection 32 representing a baby finger. All of the vertical projections include fingertip glove contact cap 52.

The fingertip glove contact caps 52 can be made of molded plastic or any other material, even a material that could absorb moisture from inside the glove finger passages in thumb passage which would dry out when the glove is removed.

Figure 4:
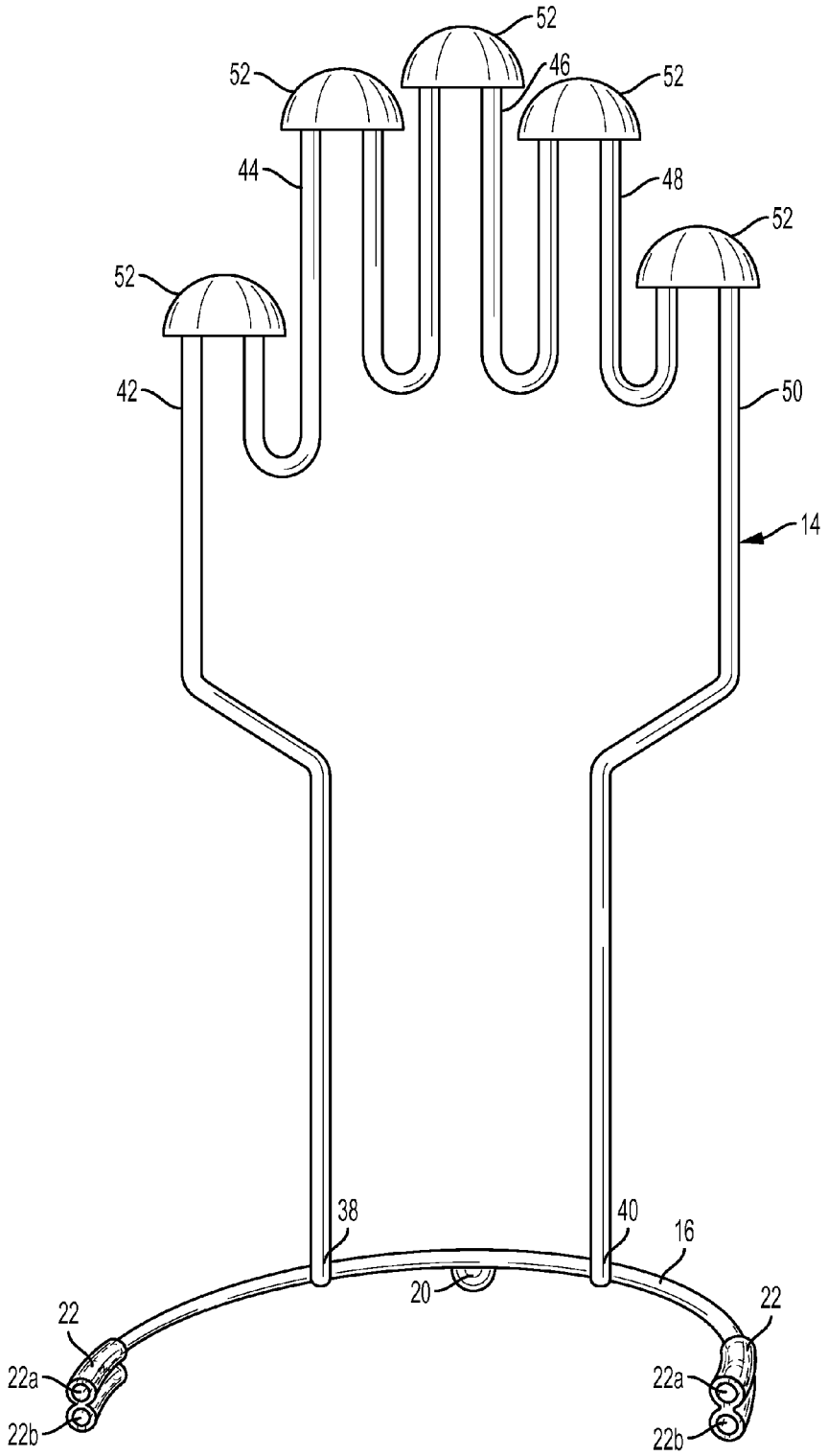
FIG. 4 shows a perspective view of half of the invention separated at the base.

FIG. 4 shows a perspective view of the second frame 14 by itself detached from the first frame 12 and semi-circular base member 16. The first frame 12 and base member 18 shown in FIG. 3 can be manually attached to fastener 22*b* behind and parallel to the second frame 14 and base member 18 for a storage mode. In the storage mode the first frame 12 and semicircular base member 18 would be connected together and almost parallel to the second frame 14 and semicircular base 18.

Figure 5:
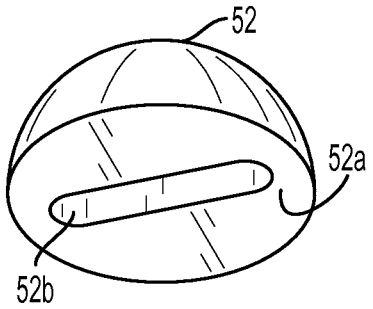
FIG. 5 shows a bottom perspective view of the finger tip glove contact cap used in the invention.
Figure 6:
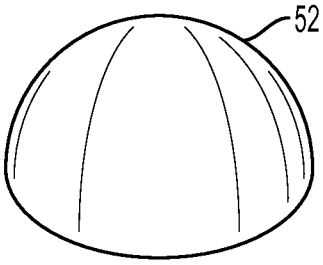
FIG. 6 shows a top perspective view of a finger tip glove contact cap used in the invention.
Figure 7:
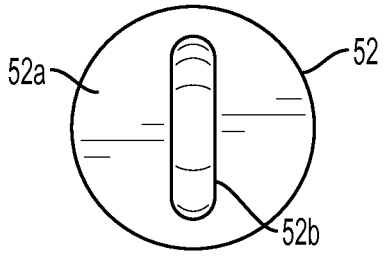
FIG. 7 shows a bottom plan view of a fingertip glove contact cap used in the invention.

FIGS. 5, 6, and 7 show a fingertip glove contact cap 52 that is attached to the top end of each vertical frame projection (as shown in FIG. 1) to spread open the glove finger passages when a glove is placed on the first frame 12 and the second frame 14. Cap 52 also supports the glove vertically. This cap in some embodiments is a hemisphere with a flat bottom 52*a* that has an oval-shaped slot 52*b* that receives the curved end of each vertical projection of the first frame 12 and second frame 14. The caps 52 can be removable or glued to the first and second frame vertical projections.

Referring back to FIG. 1, the device is used by placing a left hand glove and a right hand glove vertically over the first and second frames 12 and 14. Each glove may be pulled downwardly to flatten the glove shape vertically so that the glove opening is wide for air circulation and the downward pull of gravity to eliminate moisture inside each glove. When the device is not in use, the device is separated into halves that are joined in parallel for storage.

What I claim is:

1. A device for vertically supporting and drying a pair of work gloves comprising:

a first rod-shaped frame and a second rod-shaped frame, said first frame and said second frame each having five vertical projections representing a thumb and four fingers of a hand;

first and second rigid rod-shaped semi-circular bases;

said first frame attached vertically to said first semi-circular base and said second frame firmly attached vertically to said second semi-circular base; and hemispherically-shaped fingertip glove contact end cap attached to the end tip of each vertical first and second frame projections; and fasteners in the form of sleeves connecting said first semi-circular rod-shaped base to said second semi-circular base, forming a circular support base by inserting end portions of the first and second semi-circular rod-shaped bases within the sleeves; wherein the circular support base is configured to be placed upon a support surface.

2. A device as in claim 1, wherein:

said first frame is parallel to said second frame.

3. A device as in claim 1, wherein:

said first frame and said second frame is constructed of a metal rod.

4. a device as in claim 1, wherein;

said fingertip glove contact end caps are removable.

* * * * *